US006857161B2

(12) United States Patent
Marshall

(10) Patent No.: US 6,857,161 B2
(45) Date of Patent: Feb. 22, 2005

(54) DUST WITHDRAWAL ARRANGEMENT

(76) Inventor: Glenn Gordon Marshall, 3235 Palacio Ct., Sparks, NV (US) 89436

( * ) Notice: Subject to any disclaimer, the term of this patent is extended or adjusted under 35 U.S.C. 154(b) by 169 days.

(21) Appl. No.: 10/053,634

(22) Filed: Jan. 24, 2002

(65) Prior Publication Data

US 2003/0135951 A1 Jul. 24, 2003

(51) Int. Cl.[7] ..... A47L 5/38
(52) U.S. Cl. ..... 15/301; 15/310
(58) Field of Search ..... 15/301, 306.1, 15/310; 454/49, 56, 67

(56) References Cited

U.S. PATENT DOCUMENTS 771,507 A * 10/1904 Strong ..... 454/67
1,676,969 A * 7/1928 Sutton et al. ..... 15/301
2,431,726 A * 12/1947 Bechtler ..... 15/301
3,314,098 A * 4/1967 Carsey ..... 15/301
4,973,202 A * 11/1990 Becker ..... 15/301
6,182,326 B1 * 2/2001 Rhea et al. ..... 15/301

* cited by examiner

*Primary Examiner*—Theresa T. Snider

(57) ABSTRACT

A dust withdrawing arrangement has a plurality of individual enclosures each enclosing a respective one of working areas from which dust has to be removed, a common enclosure which is arranged around said individual enclosures, a negative pressure generating unit for generating a negative pressure in an interior of the common enclosure, and a passage associated with each of the individual enclosures and leading exclusively to the interior of the common enclosure without communicating with passages from other individual enclosures.

4 Claims, 4 Drawing Sheets

DUST WITHDRAWAL ARRANGEMENT

BACKGROUND OF THE INVENTION

The present invention relates to dust withdrawal arrangements.

More particularly, it relates to dust withdrawal arrangements which can be used for example in mineral laboratories during sample preparation.

Dust withdrawal arrangements are known in the art. Some dust withdrawal arrangements include standard tubular pipe extraction systems. The known systems have certain disadvantages, in particular fines are lost from mineral samples during sample preparation, and/or other samples awaiting preparation are contaminated. Also, the amount of dust in the work environment is not sufficiently reduced to satisfy health and safety concerns.

SUMMARY OF THE INVENTION

Accordingly, it is an object of the present invention to provide a dust withdrawing arrangement which avoids the disadvantages of the prior art.

In keeping with these objects and with others which will become apparent hereinafter, one feature of the present invention resides, briefly in a dust withdrawing arrangement which has a plurality of individual enclosures each enclosing a respective one of working areas from which dust has to be removed; a common enclosure which is arranged around said individual enclosures; means for creating a negative pressure in an interior of said common enclosure; and passage means associated with each of individual enclosures and leading exclusively from each of the individual enclosures to the interior of said common enclosure without communicating with other individual enclosures.

When the dust withdrawing arrangement is designed in accordance with the present invention, it allows dust withdrawal from each individual work station without intermixing with dust from other work stations, so that cross contamination of samples in the work stations is prevented and no fines are lost from samples in various working stations. Also, the amount of free dust in the work environment is reduced to better address health and safety concerns.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
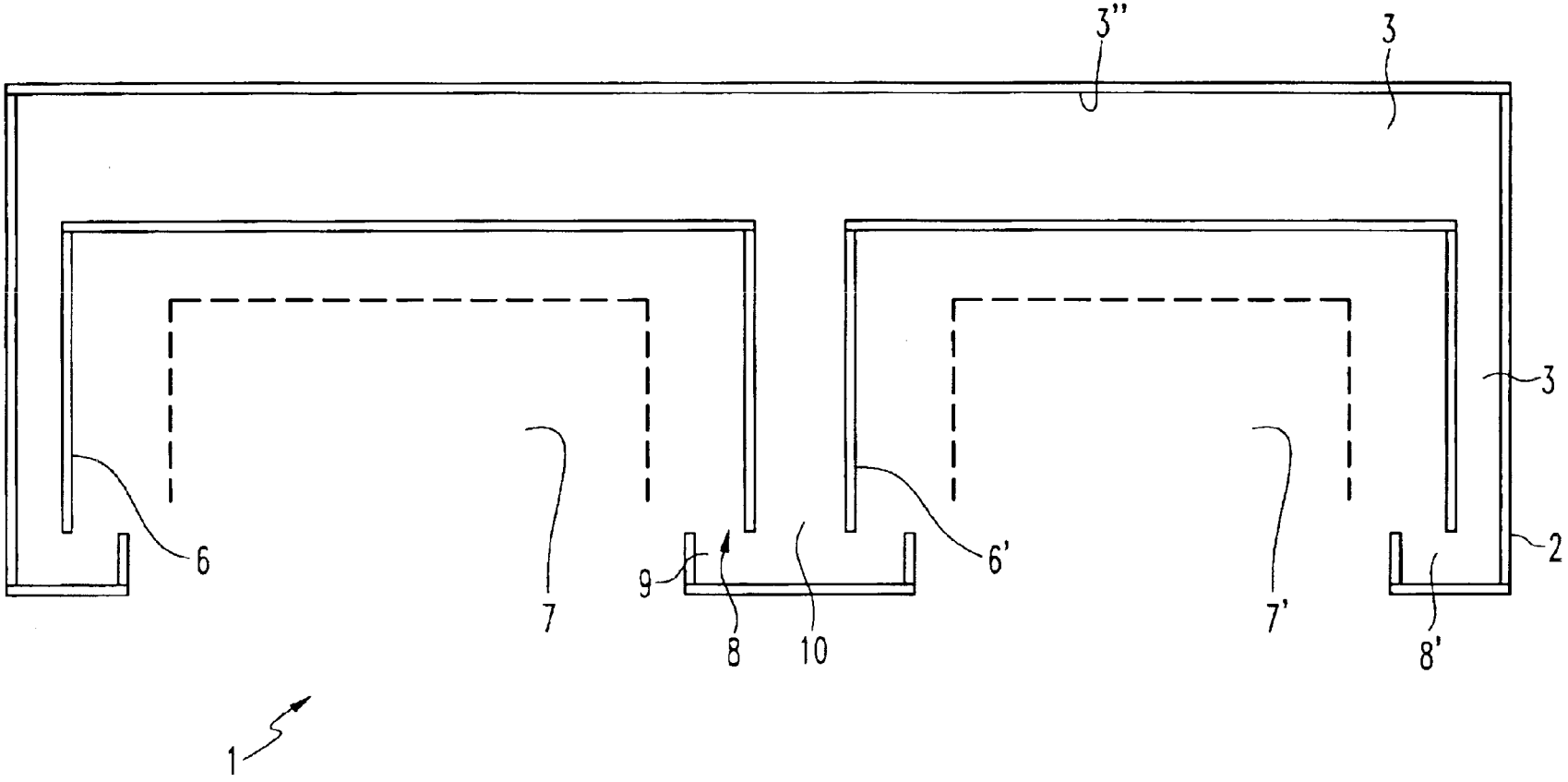
FIG. 1 is a view schematically showing a dust withdrawing arrangement in accordance with the present invention illustrating two work stations.
Figure 2:
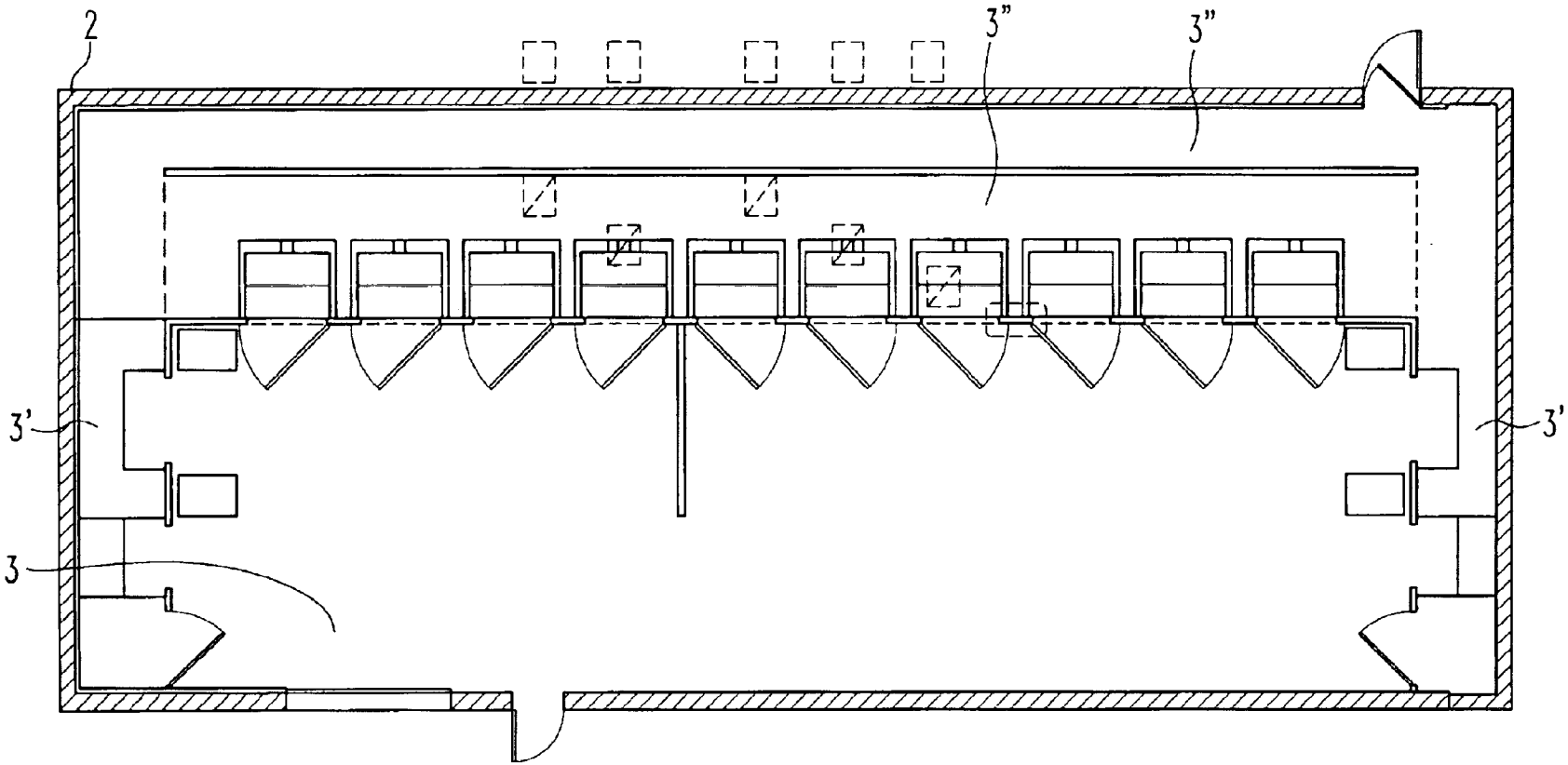
FIG. 2 is a plan view of the inventive dust withdrawal arrangement.
Figure 3:
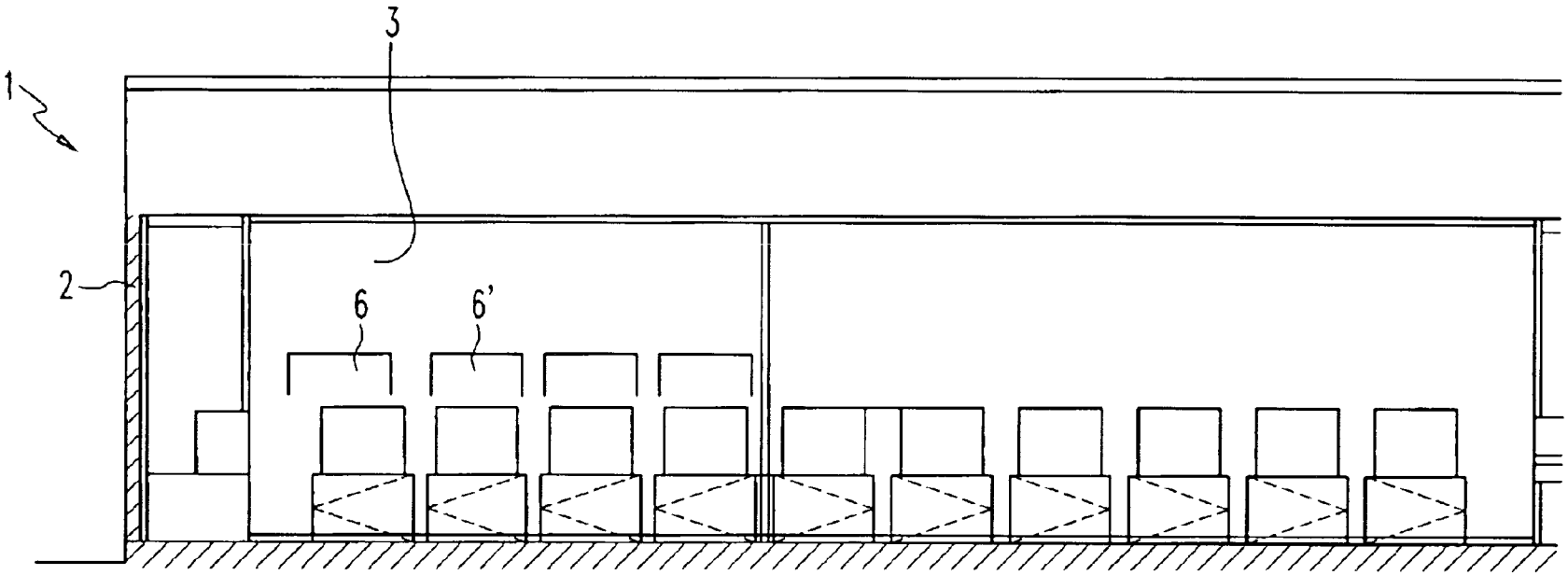
FIG. 3 is a side view of the inventive dust withdrawal arrangement in a cross-section.
Figure 4:
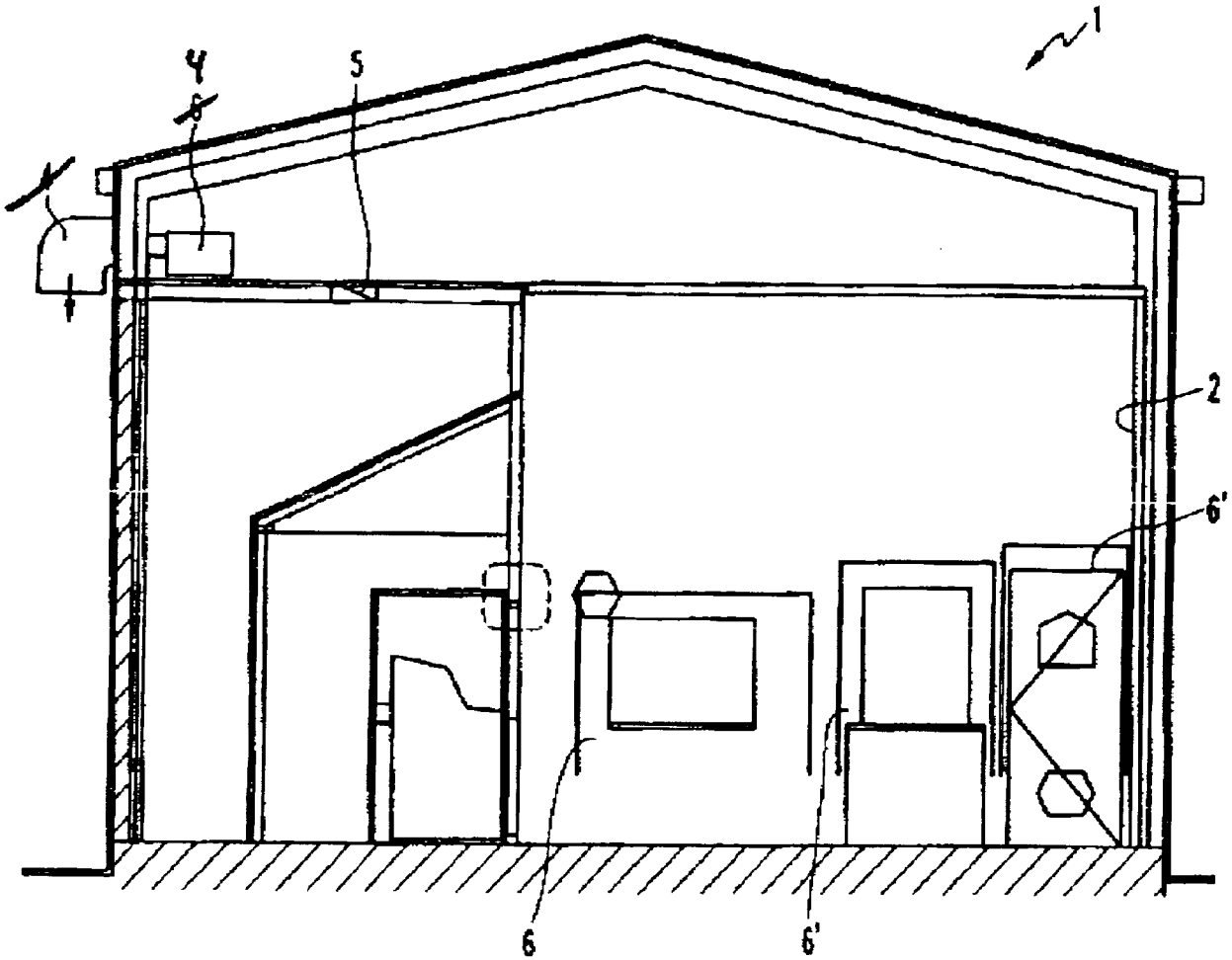
FIG. 4 is an end view of the inventive dust withdrawal arrangement in a cross-section.

A dust withdrawal arrangement in accordance with the present invention is identified as a whole with reference numeral 1. The inventive dust withdrawal arrangement has a common enclosure which is identified with reference numeral 2 and encloses an inner space 3.

The arrangement is provided with a source of negative pressure which creates negative pressure or vacuum in the inner space 3 of the common enclosure 2. The negative pressure or vacuum source can be formed for example as an extraction blower 4 which communicates with the inner space 3 through a plurality of intake vents 5.

The dust withdrawal arrangement of the invention further has a plurality of individual enclosures which are identified with reference numerals 6, 6', etc. Each of the individual enclosures limits an inner space which is identified with reference numerals 7, 7', etc and receives a corresponding work station. The individual enclosure 6 are spaced from one another, for example in a horizontal direction.

Each of the individual enclosures is provided with a passage or a gap which is identified with reference numerals 8, 8' etc and are formed so that, when a negative pressure or vacuum is produced in the inner space 3 of the common enclosure 2, dust accumulated in each of the individual enclosures, for example in the inner space 7, the individual enclosure 6 is aspirated through the passage or gap 8 directly into the inner space 3 of the common enclosure 2 without intermixing with dust into other inner spaces, for example to the inner space 7'.

As can be seen from the drawings, in the illustrated embodiment each passage or gap has a portion 9 through which the dust from one individual enclosure passes, and then a joint passage 10 which can be formed as a space between two neighboring individual enclosures. As can be seen from figures of the drawing the inner space 3 inside the common enclosure includes a partial inner space 3' located at opposite sides of the enclosure, a partial inner space 3" located above the individual enclosures, and a partial inner space 3" located behind the individual enclosures. It is believed to be clear that the inner space 3 inside the common enclosure 2 can be located at any and/or sides of the individual enclosures. It is also believed to be clear that any source of creating a negative pressure or vacuum in the inner space 3 of the enclosure 2 can be used for the inventive arrangement.

The inventive arrangement operates in the following manner. When in the work stations sample preparation is performed and the source of negative pressure or vacuum is activated, dust from each individual enclosure which encloses each individual station is aspirated through each individual passage or slot into the inner space of the common enclosure. The low velocity of an airflow in the inner space 3 allows the dust particulate to settle on the floor of the inner space 3, allowing only clean air to exhaust from inner space 3.

It will be understood that each of the elements described above, or two or more together, may also find a useful application in other types of constructions differing from the types described above.

While the invention has been illustrated and described as embodied in dust withdrawal arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A dust withdrawing arrangement, comprising a plurality of individual enclosures each having an inner space for receiving a respective one of work stations from which dust has to be removed; a common enclosure which is arranged around said individual enclosures; means for creating a negative pressure in an interior of said common enclosure; and passage means for withdrawing dust from said inner space of each of said individual enclosures exclusively into the interior of said common enclosure without communicating with the inner spaces of other individual enclosures, said individual enclosures including at least two neighboring individual enclosures, said passage means including a gap communicating the inner spaces of said two neighboring individual enclosures with the interior of said common enclosure and having portions through which the dust passes from one of said two neighboring individual enclosures and a joint passage formed as a space between walls of said two neighboring individual enclosures, so that the dust from said inner spaces of said two neighboring individual enclosures is withdrawn through said portions communicating with said inner spaces of said two neighboring individual enclosures and then through said joint passage which communicates with said portions and also communicates with the interior of said common enclosure.

2. A dust withdrawing arrangement, comprising a plurality of individual enclosures each having an inner space for receiving a respective one of work stations from which dust has to be removed; a common enclosure which is arranged around said individual enclosures; means for creating a negative pressure in an interior of said common enclosure; and passage means for withdrawing dust from said inner space of each or said individual enclosure exclusively into the interior of said common enclosure without communicating with the inner spaces of other individual enclosures, said common enclosure being arranged so that a space remains at least at one side of said common enclosure between a wall of said common enclosure and a wall of at least one of said individual enclosures, said passage means including a gap communicating with said inner space of said at least one individual enclosure and also with said space which remains at least at one side of said common enclosure between said wall of said common enclosure and said wall of at least one individual enclosure, which space in turn communicates with the interior of said common enclosure.

3. A dust withdrawing arrangement, comprising a plurality of individual enclosures each having an inner space for receiving a respective one of work stations from which dust has to be removed; a common enclosure which is arranged around said individual enclosures; means for creating a negative pressure in an interior of said common enclosure; and passage means for withdrawing dust from said inner space of each of said individual enclosures exclusively into the interior of said common enclosure without communicating with the inner spaces of other individual enclosures, wherein a joint passage is formed between and by walls of two neighboring individual enclosures, said common enclosure being arranged so that a space remains at least at one side of said common enclosure between a wall of said common enclosure and a wall of at least one of said individual enclosures, said passage means including a gap communicating with said inner space of said at least one individual enclosure and also with said space which remains at least at one side of said common enclosure between said wall of said common enclosure and said wall of said at least one individual enclosure, which space in turn communicates with the interior of said common enclosure, said individual enclosures including at least two neighboring individual enclosures, said passage means including said gap communicating the inner space of said two neighboring individual enclosures with the interior of said common enclosure and having portions through which the dust pauses from one of said two neighboring individual enclosures and then said joint passage formed as a space between walls of said two neighboring individual enclosures, so that the dust from said inner spaces of said two neighboring individual enclosures is withdrawn through said portions communicating with said inner spaces of said two neighboring individual enclosures and then through said joint passage which communicates with said portions and also communicates with the interior of said common enclosure.

4. A dust withdrawing arrangement comprising a plurality of individual enclosures each having an inner space for receiving a respective one of work stations, from which dust has to be removed; a common enclosure which is arranged around said individual enclosures; means for creating a pressure in said enclosures; and passage means for withdrawing dust from said inner space of each of said individual enclosures into the interior of said common enclosure without communicating with the inner spaces of other individual enclosures, each of said individual enclosures having an upper wall end a side wall formed so that a corresponding one of the work stations is completely confined inside said inner space formed by said walls of a corresponding one or said individual enclosures.

* * * * *